US005358237A

United States Patent [19]

Yu

[11] Patent Number: 5,358,237

[45] Date of Patent: Oct. 25, 1994

[54] BASKETBALL GAME ASSEMBLY

[76] Inventor: I-chin Yu, No. 20, Lane 492. Shui-Yun Rd., Feng-Yuan, Taiwan

[21] Appl. No.: 212,846

[22] Filed: Mar. 15, 1994

[51] Int. Cl.[5] ..... A63B 63/08

[52] U.S. Cl. ..... 273/1.5 R; 273/382; 273/383; 273/389

[58] Field of Search ..... 273/1.5 R, 85 R, 378, 273/381, 382, 383, 386, 387, 389, 398, 400, 401, 402

[56] References Cited

U.S. PATENT DOCUMENTS

| | | | |
|---|---|---|---|
| 1,819,475 | 8/1931 | Morley | 273/387 |
| 1,927,067 | 9/1933 | Manassero | 273/389 X |
| 1,995,872 | 3/1935 | Ukanavage | 273/1.5 R |
| 2,192,430 | 3/1940 | Branner | 273/1.5 R |
| 2,593,758 | 4/1952 | Holmdahl | 273/1.5 R |
| 2,926,916 | 3/1960 | Pearson, Jr. | 273/387 X |
| 3,074,720 | 1/1963 | Carver et al. | 273/383 X |
| 3,092,387 | 6/1963 | Wagner | 273/85 R |
| 5,294,913 | 3/1994 | Mower et al. | 273/1.5 R X |

*Primary Examiner*—William H. Grieb
*Attorney, Agent, or Firm*—Bacon & Thomas

[57] ABSTRACT

A basketball game includes a board and a ring secured to the board, the board has an opening formed in middle portion and has a door panel pivotally coupled to the board for closing the opening, a beam has one end pivotally coupled to the board and the other end extended in the ring, and a lever couples the beam to the door panel. The door panel can be opened by the lever when the beam is depressed by a basketball, a funny face may be seen when the door panel is opened so as to cheer or greet the shot.

4 Claims, 4 Drawing Sheets

BASKETBALL GAME ASSEMBLY

BACKGROUND OF THE INVENTION

1. Field of the Invention

The present invention relates to a game, and more particularly to a basketball game assembly.

2. Description of the Prior Art

Typical basketball stands comprise a ring secured to a board for supporting netting member, when a basketball is shot through the ring, no means are provided for showing or indicating the shot.

The present invention has arisen to mitigate and/or obviate the afore-described disadvantages of the conventional basketball games.

SUMMARY OF THE INVENTION

The primary objective of the present invention is to provide a basketball game assembly which includes means for indicating the shot of the basketball through the ring.

In accordance with one aspect of the invention, there is provided a basketball game assembly which comprises a board including an opening formed therein and including a front portion and a rear portion, at least one door panel pivotally coupled to the board for closing the opening; channel means provided in the rear portion of the board; a slide slidably engaged in the channel means and movable toward or away from the door panel; means coupling the slide to the door panel for opening or closing the door panel when the slide moves toward or away from the door panel; a ring secured to the front portion of the board; a beam including a first end pivotally coupled to the board and a second end extended in the ring; means for biasing the beam to a position in parallel with the ring; and lever means coupling the beam to the slide. The door panel can be opened by the slide and the lever means when the beam is depressed.

The slide includes a plate extended upward therefrom, the plate includes a front surface having a print provided thereon for cheering or greeting the shot of the basketball. The board includes at least one bell provided therein for engaging with the plate, the bell is actuated by the plate when the door panel is opened. The coupling means includes a first tube secured to the door panel, a second tube secured to the plate, and a link pivotally engaged with the first tube and the second tube, whereby, the door panel is opened when the slide moves along the channel means.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
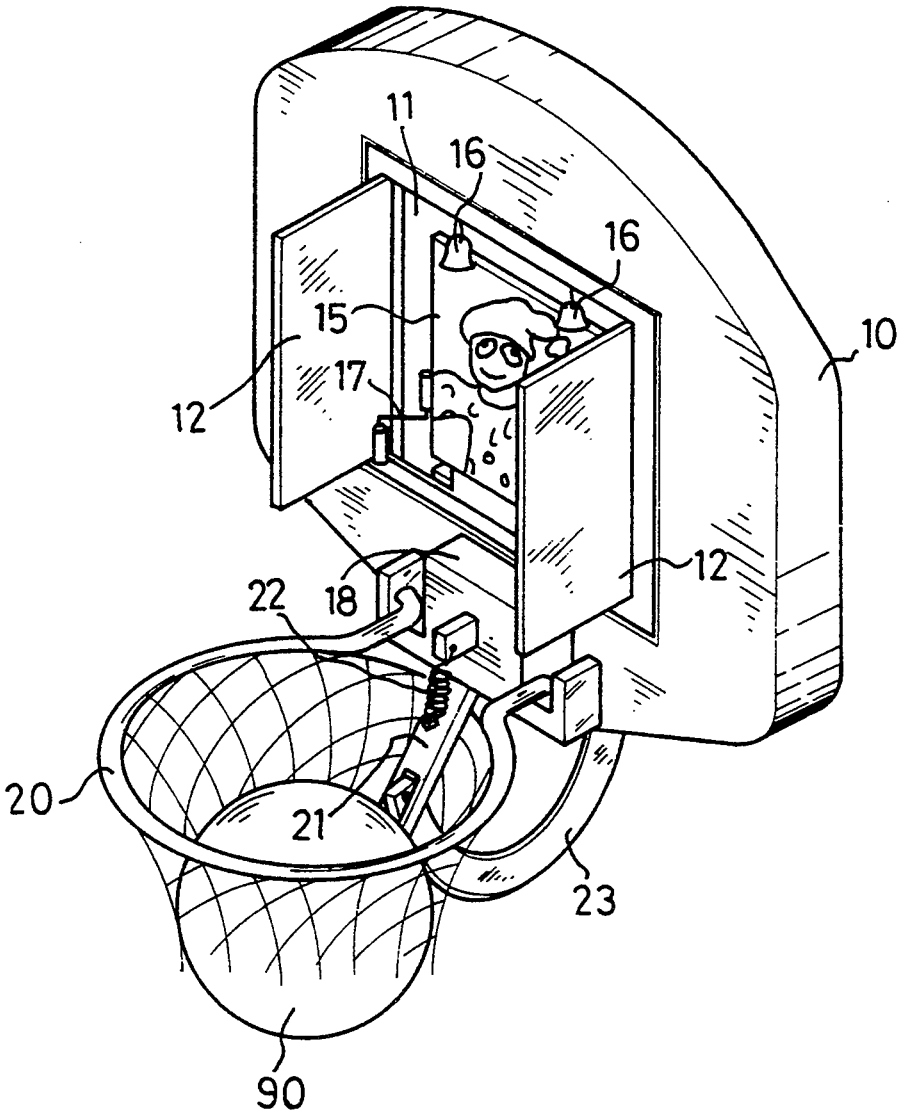
FIG. 1 is a front perspective view of a basketball game assembly in accordance with the present invention.
Figure 2:
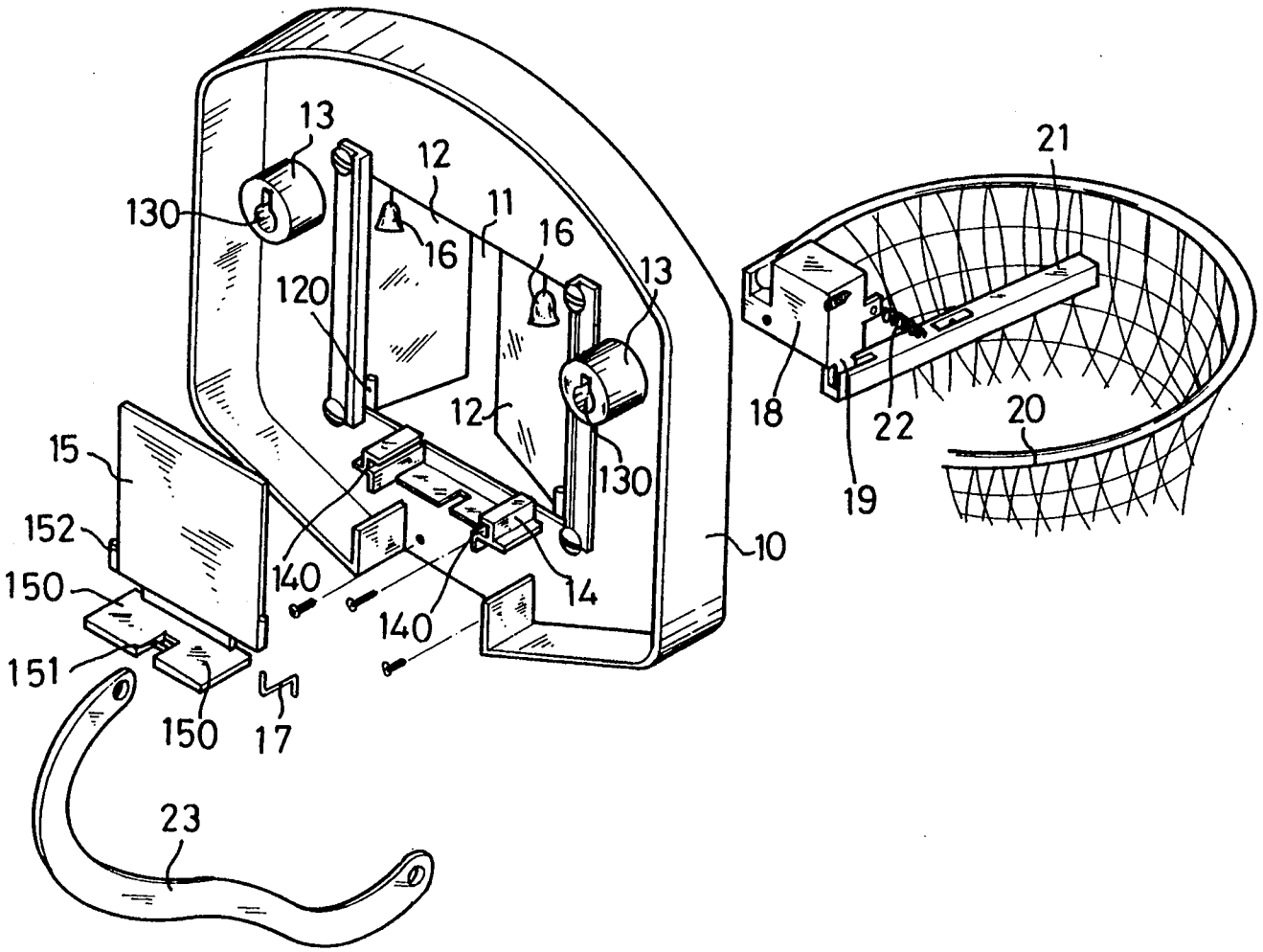
FIG. 2 is a rear exploded view of the basketball game assembly.
Figure 3:
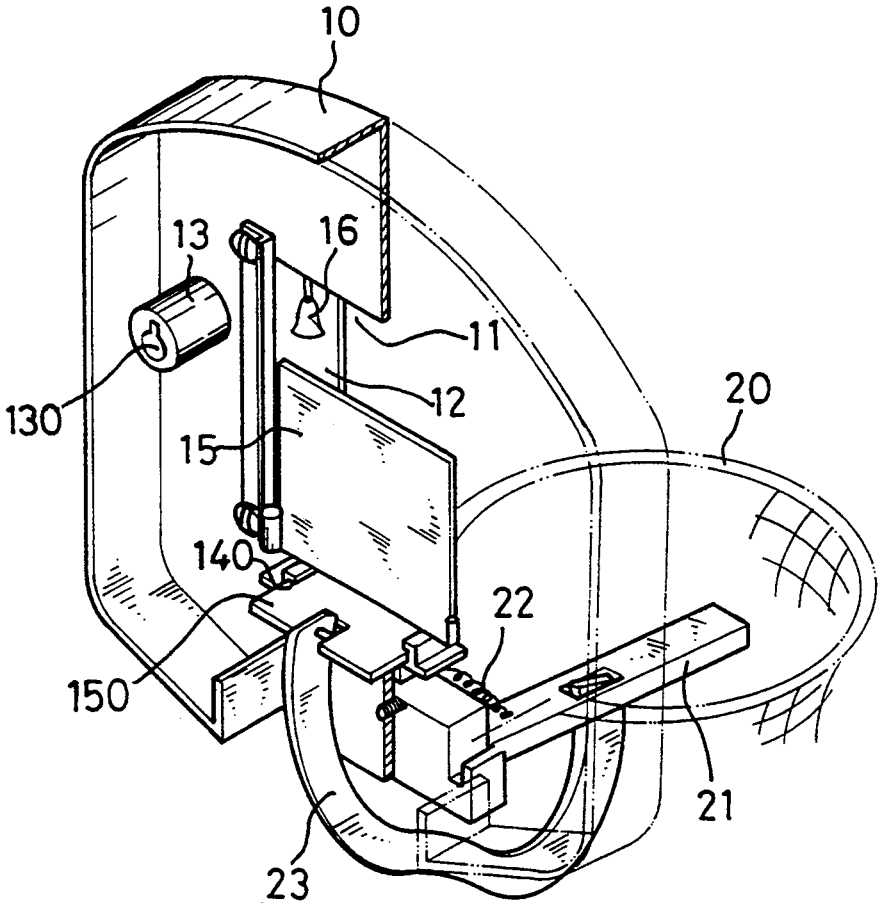
FIG. 3 is a rear perspective view of the basketball game assembly.

Referring to the drawings, and initially to FIGS. 1 to 3, a basketball game assembly in accordance with the present invention comprises a board 10 including an opening 11 formed therein, a pair of door panels 12 pivotally coupled to the board 10 for closing the opening 11 and each door panel 12 including a tube 120 secured thereto, two stubs 13 extended rearward from the board 10 and each having a key hole 130 formed therein for engaging with nails on a wall member such that the board may be secured to the wall member, a guiding device 14 including a pair of channels 140 formed therein for slidably receiving a slide 150 such that the slide 150 may move forward and rearward along the channels 140, a plate 15 extended upward from the slide 150 and move in concert with the slide 150, a pin 151 provided in the slide 150, two tubes 152 fixed on two sides of the plate 15, one or more bells 16 hung in the opening 11, and two links 17 having two ends engaged with the tubes 120, 152 so as to couple the plate and the door panels 12 together, such that the door panels 12 can be opened when the plate 15 moves forward toward the door panels and the door panels 12 can be closed when the plate 15 moves away from the door panels 12, a block 18 fixed to the board 10 and located below the opening 11, an extension 19 extended downward from the block 18, a ring 20 fixed to the block 18, a beam 21 including one end pivotally coupled to the extension 19 and the other end extended within the ring 20, a lever 23 including one end pivotally coupled to the pin 151 of the slide 150 and the other end pivotally coupled to the middle portion of the beam 23, and a spring 22 coupled between the block 18 and the beam 21 for biasing the beam 21 upward to a horizontal position.

Figure 4:
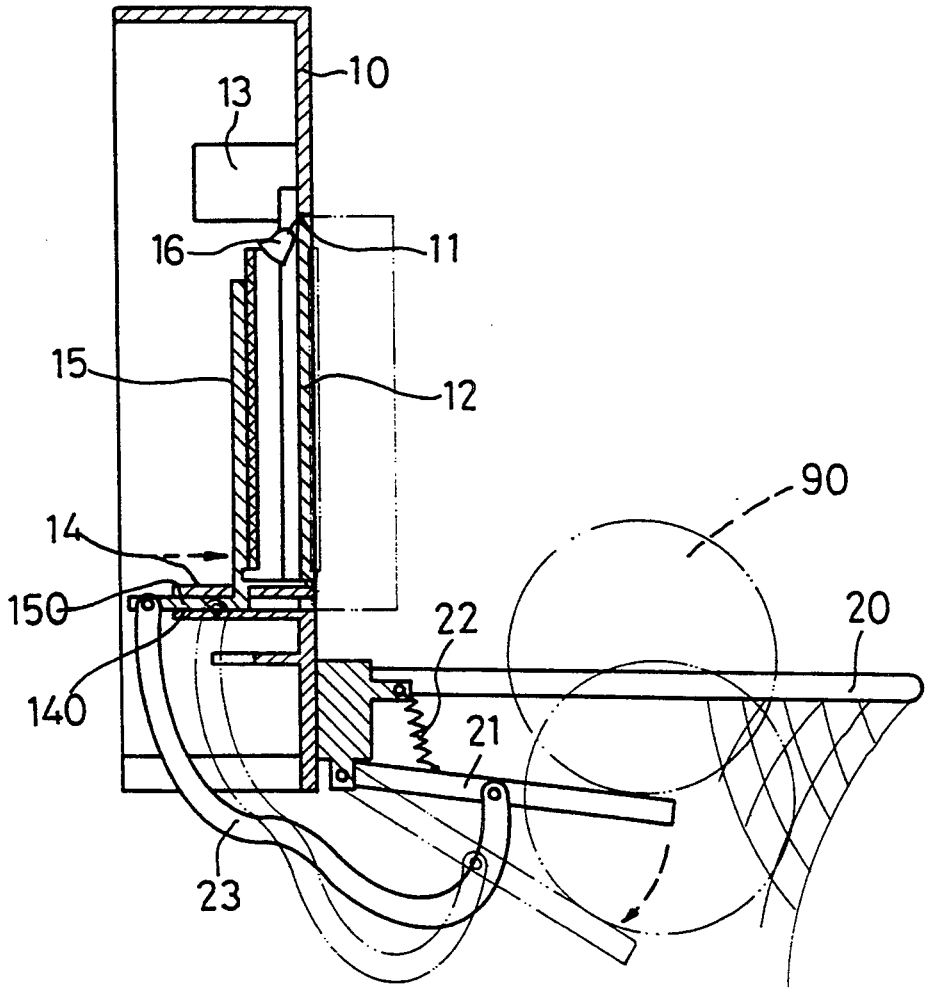
FIG. 4 is a cross sectional view of the basketball game assembly.

In operation, please refer to FIG. 4 and again to FIG. 1, when a basketball 90 is shot through the ring 20, the beam 21 will be moved downward, the slide 150 will thus be pushed forward by the lever 23, and the door panels 12 can thus be opened by the plate 15 and the links 17, the bells 16 will be actuated by the plate 15 so as to indicate the shot of the basketball. The front surface of the plate 15 may be printed with funny face or other prints in order to cheer or greet the shot.

Accordingly, the basketball game assembly in accordance with the present invention includes means for indicating the shots of the basketball.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A basketball game assembly comprising:

a board including an opening formed therein and including a front portion and a rear portion, at least one door panel pivotally coupled to said board for closing said opening;

channel means provided in said rear portion of said board;

a slide slidably engaged in said channel means and movable toward or away from said door panel;

means coupling said slide to said door panel for opening or closing said door panel when said slide moves toward or away from said door panel;

a ring secured to said front portion of said board;

a beam including a first end pivotally coupled to said board and a second end extended in said ring;

means for biasing said beam to a position in parallel with said ring; and lever means coupling said beam to said slide;

said door panel being opened by said slide and said lever means when said beam is depressed.

2. A basketball game assembly according to claim 1, wherein said slide includes a plate extended upward therefrom, said plate includes a front surface having a print provided thereon.

3. A basketball game assembly according to claim 2, wherein said board includes at least one bell provided therein for engaging with said plate, said bell is actuated by said plate when said door panel is opened.

4. A basketball game assembly according to claim 2, wherein said coupling means includes a first tube secured to said door panel, a second tube secured to said plate, and a link pivotally engaged with said first tube and said second tube, whereby, said door panel is opened when said slide moves along said channel means.

* * * * *